US008091192B2

(12) United States Patent
Bayer et al.

(10) Patent No.: US 8,091,192 B2
(45) Date of Patent: Jan. 10, 2012

(54) DEVICE FOR SURFACE BLASTING COMPONENT

(75) Inventors: Erwin Bayer, Dachau (DE); Thomas Dautl, Weichs (DE); Thomas Peschke, Groebenzell (DE); Holger Polanetzki, Dachau (DE)

(73) Assignee: MTU Aero Engines GmbH, Munich (DE)

( * ) Notice: Subject to any disclaimer, the term of this patent is extended or adjusted under 35 U.S.C. 154(b) by 1923 days.

(21) Appl. No.: 11/198,718

(22) Filed: Aug. 5, 2005

(65) Prior Publication Data

US 2006/0174483 A1 Aug. 10, 2006

(30) Foreign Application Priority Data

Aug. 5, 2004 (DE) ..... 10 2004 037 954

(51) Int. Cl.
*B24B 39/00* (2006.01)
*C21D 7/06* (2006.01)

(52) U.S. Cl. ..... 29/90.7; 72/53; 72/710; 451/165; 451/910

(58) Field of Classification Search ..... 29/90.7, 29/889.7, 889.21, 889.22, 889.23, 889.2; 72/53, 710; 451/162, 165, 910
See application file for complete search history.

(56) References Cited

U.S. PATENT DOCUMENTS 3,967,413 A * 7/1976 Ferrara ..... 451/326
4,991,360 A 2/1991 DeSpain
5,271,184 A * 12/1993 Majors ..... 451/113
5,976,314 A * 11/1999 Sans ..... 156/580.1
6,289,705 B1 * 9/2001 Duquenne et al. ..... 72/53
6,336,844 B1 * 1/2002 Duquenne et al. ..... 451/36
6,343,495 B1 * 2/2002 Cheppe et al. ..... 72/53
6,490,899 B2 * 12/2002 Berthelet et al. ..... 72/53
6,505,489 B2 * 1/2003 Berthelet et al. ..... 72/53
6,508,093 B2 * 1/2003 Berthelet et al. ..... 72/53
6,536,109 B2 3/2003 Berthelet et al.
6,606,892 B2 * 8/2003 Fischer et al. ..... 72/53
6,740,197 B2 * 5/2004 Sans ..... 156/580.2
6,837,085 B2 * 1/2005 Berthelet et al. ..... 72/53
7,028,378 B2 * 4/2006 Cheppe et al. ..... 29/90.7
7,389,663 B2 * 6/2008 Cheppe et al. ..... 72/53
7,481,088 B2 * 1/2009 Bayer et al. ..... 72/53
7,665,338 B2 * 2/2010 Cheppe et al. ..... 72/53
7,673,486 B2 * 3/2010 Bayer et al. ..... 72/53
7,992,416 B2 * 8/2011 Stonitsch et al. ..... 72/53
2002/0042978 A1 4/2002 Cheppe et al.
2006/0021410 A1 * 2/2006 Cheppe et al. ..... 72/53
2008/0282756 A1 * 11/2008 Cheppe et al. ..... 72/53
2009/0288463 A1 * 11/2009 Cheppe et al. ..... 72/53
2009/0301152 A1 * 12/2009 Bayer et al. ..... 72/53

* cited by examiner

*Primary Examiner* — Essama Omgba
(74) *Attorney, Agent, or Firm* — Kenyon & Kenyon LLP

(57) ABSTRACT

A device for surface blasting, e.g., for ultrasonic shot blasting, components, e.g., gas turbine components, includes at least one vibrator having an oscillating surface, e.g., having at least one ultrasonic sonotrode, the or each oscillating surface of the or each vibrator being adjoined by a machining chamber for receiving a section to be blasted of the component to be machined. The machining chamber is bounded in its cross-section by at least three sides, e.g., by at least two substantially vertical sides and by at least one substantially horizontal side. At least the substantially vertical sides of the machining chamber are formed by oscillating surfaces of in each case one vibrator.

24 Claims, 4 Drawing Sheets

DEVICE FOR SURFACE BLASTING COMPONENT

CROSS-REFERENCE TO RELATED APPLICATIONS

The present application claims priority to Application No. 10 2004 037 954.8, filed in the Federal Republic of Germany on Aug. 5, 2004, which is expressly incorporated herein in its entirety by reference thereto.

FIELD OF THE INVENTION

The present invention relates to a device for surface blasting, e.g., for ultrasonic shot blasting, components, e.g., gas turbine components.

BACKGROUND INFORMATION

Gas turbines, particularly aircraft engines, have at least one rotor equipped with rotating moving blades, particularly in the region of a compressor and of a turbine, the rotating moving blades of the gas turbine being either anchored by profiled blade roots in recesses of the gas turbine rotor or being an integral part of a gas turbine rotor. If the moving blades are anchored by blade roots in corresponding recesses of the rotor, then the blade roots are profiled either according to the so-called fir tree design or according to the so-called dovetail design. The fir tree-profiled or dovetail-profiled surfaces of a root of a gas turbine blade are also called bearing flanks or bearing surfaces. During the operation of a gas turbine, the blade roots are highly stressed on their profiled bearing surfaces, particularly by fretting. The wear rate in the region of the blade roots may be reduced by hardening the blade roots on their bearing surfaces using special surface machining methods. A similar problem may arise with respect to integrally bladed gas turbine rotors, which are hardened in the region of their rotor discs so as to minimize the wear rate. The surfaces of the blades of gas turbines blades are also hardened to minimize the wear rate.

Shot blasting may be used as a surface machining method for hardening components, particularly of gas turbine components such as gas turbine blades. In conventional shot blasting, a significant surface roughening may occur on the blasted surfaces. For improving the machining quality resulting from shot blasting, it is described in U.S. Pat. No. 6,536,109 to harden blade roots of gas turbine blades, for example, in the region of their profiled bearing surfaces using ultrasonic shot blasting.

Thus, U.S. Pat. No. 6,536,109 describes such a device having an ultrasonic sonotrode, the ultrasonic sonotrode having a horizontal or level vibrating or oscillating surface, and a machining chamber extending above this oscillating surface, in which gas turbine blades with their blade roots are arranged upright for machining the blade roots in the region of their bearing surfaces. According to U.S. Pat. No. 6,536,109, for this purpose, the gas turbine blades are oriented upright such that the profiled bearing surfaces of the blade roots to be machined extend essentially perpendicular to the oscillating surface of the ultrasonic sonotrode. In this manner, it is possible to achieve only an insufficient quality in shot blasting the profiled bearing surfaces of the blade roots. Furthermore, using the device described in U.S. Pat. No. 6,536,109, it may not be possible to blast thin-walled components, since such thin-walled components may be exposed to unacceptable deformation when machined in this device.

SUMMARY

An example embodiment of the present invention may provide a device for surface blasting, e.g., ultrasonic shot blasting, of components.

According to an example embodiment of the present invention, a machining chamber is bounded in its cross-section by at least three sides, e.g., by at least two substantially vertical sides and by at least one substantially horizontal side, at least the vertical sides of the machining chamber being formed by oscillating surfaces of in each case one vibrator. The machining chamber has a W-shaped or V-shaped cross-section, at least the vertical sides of the cross-sectionally W-shaped or V-shaped machining chamber being formed by oscillating surfaces of in each case one vibrator. The horizontal sides may be formed as surfaces of in each case one vibrator or as injectors, the injectors moving the beads back onto the vibrating, substantially vertical sides.

With a device for surface blasting components according to an example embodiment of the present invention, it may be possible to achieve an improved machining quality on the component surfaces to be machined compared to conventional devices. Furthermore, a device according to an example embodiment of the present invention may allow, for example, for a machining of blade roots or even of the blades of gas turbine blades such that sections to be hardened are simultaneously blasted from two opposite sides. On the one hand, this may increase the effectiveness in surface blasting, while on the other hand, e.g., in the case of thin-walled components, may avoid unacceptable deformations of the thin-walled component sections to be blasted. A device according to an example embodiment of the present invention may allow for the high intensity bombardment even of thin-walled disks having so-called wings on integrally bladed gas turbine rotors in ultrasonic shot blasting, without unacceptably deforming these complexly formed components in surface blasting.

According to an example embodiment of the present invention, the cross-sectionally W-shaped or V-shaped machining chamber is bounded by two outer, substantially vertical long sides and at least one inner, substantially horizontal short side, each of the sides being formed by an oscillating surface of in each case one vibrator. In transition regions between outer long sides and inner short sides or at the low marks of the cross-sectionally W-shaped or V-shaped machining chamber, e.g., in each case an additional oscillating surface of a vibrator is positioned or an injector is provided for the beads.

According to an example embodiment of the present invention, a device for surface blasting a component includes: at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by one of the oscillating surfaces.

The surface blasting may include ultrasonic shot blasting.

The component may include a gas turbine component.

The at least one vibrator may include at least one ultrasonic sonotrode.

A cross-section of the machining chamber may be one of (a) W-shaped and (b) v-shaped.

A cross-section of the machining chamber may be W-shaped, and the at least three sides may include two substantially horizontal sides and two substantially vertical sides.

A cross-section of the machining chamber may be W-shaped and may be bounded by two outer, substantially vertical long sides and two inner, substantially horizontal short sides. Each of the outer, substantially vertical long sides and the inner, substantially horizontal short sides may be formed by one of the oscillating surfaces.

Each transition region between the outer, substantially vertical long sides and the inner, substantially horizontal short sides may one of (a) form one of the oscillating surfaces and (b) include an injector.

One of (a) the oscillating surfaces at the transition regions and (b) the injectors may be arranged at low points of the W-shaped cross-section of the machining chamber.

The machining chamber may be bounded by one of (a) six oscillating surfaces and (b) four oscillating surfaces and two injectors.

A cross-section of the machining chamber may be V-shaped and may include two substantially vertical sides and one substantially horizontal side. At least each of the substantially vertical sides may be formed by one of the oscillating surfaces.

The substantially horizontal side may be formed by one of the oscillating surfaces.

The substantially horizontal side may include an injector.

Each transition region between the substantially vertical sides and the substantially horizontal side may one of (a) form one of the oscillating surfaces and (b) include an injector.

The substantially vertical sides may be arranged approximately parallel to one of (a) a surface contour and (b) an envelope of the surface contour to be blasted of the section of the component extending into the machining chamber.

According to an example embodiment of the present invention, a method includes: blasting a component in a device for surface blasting the component, the device including at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by one of the oscillating surfaces.

The blasting may include ultrasonic shot blasting the component in the device.

The component may include a gas turbine component.

The blasting may include blasting the component in the device simultaneously from both sides.

According to an example embodiment of the present invention, a method includes: simultaneously, bilaterally, ultrasonically shot blasting a component in a device for surface blasting the component, the component including one of (a) a gas turbine blade and (b) an integrally bladed gas turbine rotor, the device including at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by one of the oscillating surfaces.

The component may be shot blasted in the shot blasting step in a region of a thin-walled section.

Further aspects and features of example embodiments of the present invention are described below with reference to the appended Figures.

DETAILED DESCRIPTION

Example embodiments of the present invention are described in greater detail with reference to FIGS. 1 to 5.

Figure 1:
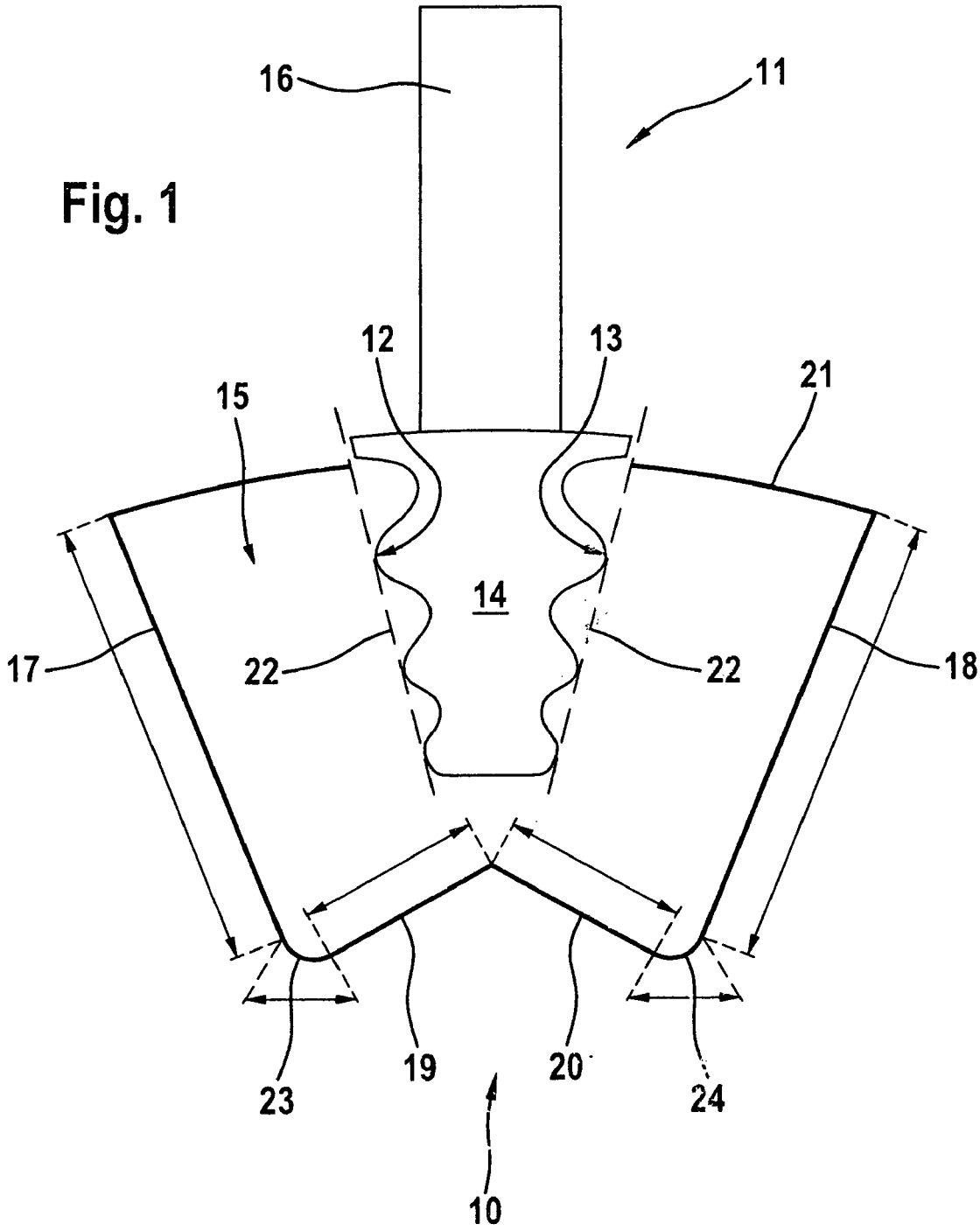
FIG. 1 is a schematic view of a device according to an example embodiment of the present invention for surface blasting, e.g., for ultrasonic shot blasting, in blasting a gas turbine blade in the region of a blade root.

FIG. 1 is a schematic view of a device 10 for ultrasonic shot blasting together with a gas turbine blade 11, which in device 10 is to be blasted at profiled bearing flanks or bearing surfaces 12 and 13 of a blade root 14. As illustrated in FIG. 1, for this purpose, blade root 14 of gas turbine blade 11 extends into a machining chamber 15 provided by the device, a blade 16 of gas turbine blade 11, which is not to be machined in FIG. 1, projecting out of machining chamber 15 of device 10.

In the exemplary embodiment illustrated in FIG. 1, machining chamber 15 is W-shaped in its cross-section or characterized by a W-profile. Thus, cross-sectionally W-shaped machining chamber 15 is bounded by two outer, substantially vertical long sides 17 and 18 as well as by two inner, substantially horizontal short sides 19 and 20. Each of these sides 17, 18, 19 and 20 is formed by a vibrating or oscillating surface of a vibrator, e.g., of an ultrasonic sonotrode. Sides 17, 18, 19 and 20 of W-shaped machining chamber 15 are therefore the oscillating surfaces of ultrasonic sonotrodes, the oscillating section of the surfaces being visualized by double arrows.

With the aid of sides 17, 18, 19 and 20 in the form of oscillating surfaces of ultrasonic sonotrodes, beads located in machining chamber 15 are accelerated and hurled in the direction of the bearing flanks or bearing surfaces 12, 13 of blade root 14. On top, machining chamber 15 is bounded by a non-oscillating cover 21, at which the beads accelerated by the ultrasonic sonotrodes are reflected. In the arrangement illustrated in FIG. 1, no preferential direction may be established for the beads within device 10 or within machining chamber 15. The beads are therefore hurled from all directions evenly distributed onto the blade root's bearing flanks or bearing surfaces 12 and 13 to be machined. This may result in a particularly uniform hardening of blade root 14 to be machined at bearing flanks or bearing surfaces 12 and 13.

It may be further provided to arrange sides 17 and 18 taking the form of vibrating surfaces of ultrasonic sonotrodes of cross-sectionally W-shaped machining chamber 15 such that sides 17 and 18 extend substantially parallel to the surface contour to be blasted. In the exemplary embodiment illustrated in FIG. 1, bearing flanks or bearing surfaces 12 and 13 of blade root 14 to be blasted are fir-tree-profiled, and sides 17 and 18 extend substantially parallel to an envelope 22 of fir-tree-profiled bearing flanks or bearing surfaces 12 and 13. This, on the one hand, may allow for the achievement of a good machining quality on bearing flanks or bearing surfaces 12 and 13 of blade root 14, while, on the other hand, may allow for both bearing flanks or bearing surfaces 12 and 13 to be blasted simultaneously. Device 10 therefore may allow for blade root 14 to be blasted simultaneously from both sides, e.g., in the region of both bearing surfaces.

As illustrated in FIG. 1, oscillating surfaces of ultrasonic sonotrodes are not only positioned in the region of sides 17, 18, 19 and 20 of cross-sectionally W-shaped machining chamber 15, but rather also in transition regions 23 and 24 between outer long sides 17 and 18 and inner short sides 19 and 20. Transition regions 23 and 24 represent so to speak the lowest points or the low marks of the W-profile of machining chamber 15, the beads accelerated by the ultrasonic sonotrodes gathering under the influence of gravity in the region of these low marks and being hurled back again into machining space 15 by the ultrasonic sonotrodes positioned there or their oscillating surfaces. Instead of the ultrasonic sonotrodes, transition regions 23 and 24 may also have injectors for the beads, which move the beads back onto the vibrating sides. The oscillating sections of the ultrasonic sonotrodes or injectors positioned in transition regions 23 and 24 are indicated by double arrows.

In the exemplary embodiment illustrated in FIG. 1, therefore, cross-sectionally W-shaped machining chamber 15 is bounded by a total of six oscillating surfaces of corresponding ultrasonic sonotrodes or by four oscillating surfaces and two injectors. An ultrasonic sonotrode is positioned in each of the regions of outer long sides 17 and 18 and inner short sides 19 and 20. At the top side, machining chamber 15 is closed by a cover 21. In the device, blade root 14 extending into machining chamber 15 may be hardened in a particularly effective and gentle manner on bearing flanks or bearing surfaces 12 and 13. Since no preferential direction may result for the beads accelerated by the ultrasonic sonotrodes, undesired material deformations and damage in the region of bearing flanks or bearing surfaces 12 and 13 to be blasted may be avoided. Furthermore, blade root 14 may be blasted from both sides at the same time, e.g., simultaneously in the region of both bearing flanks or bearing surfaces 12 and 13.

Figure 2:
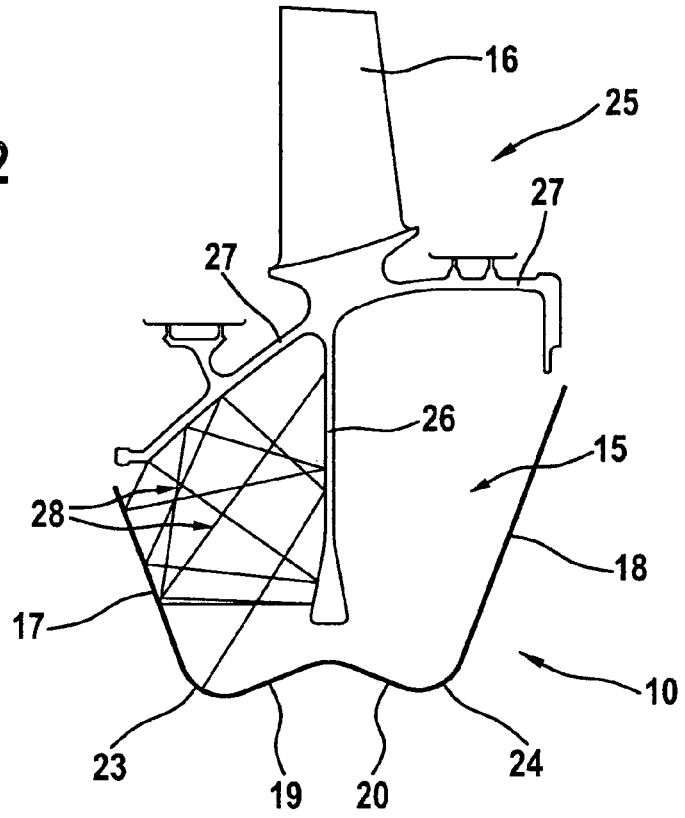
FIG. 2 illustrates a device according to an example embodiment of the present invention for surface blasting, e.g., for ultrasonic shot blasting, in blasting a rotor disk of an integrally bladed gas turbine rotor.

FIG. 2 illustrates device 10 in the blasting of an integrally bladed gas turbine rotor 25 in the region of a rotor disk 26. In the example illustrated in FIG. 2, projections 27—also referred to as wings—extend almost completely over the W-profile of machining chamber 15 that is open on top such that a cover at the top side of machining chamber 15 may be omitted. In the exemplary embodiment illustrated in FIG. 2, rotor disk 26 is blasted from both sides. As illustrated in FIG. 2, no preferential direction may be established for the beads accelerated by the sonotrodes located in the region of sides 17, 18, 19 and 20 such that the accelerated beads strike the surfaces to be hardened of rotor disk 26 from all directions. This is indicated schematically in FIG. 2 by lines 28. Since no preferential direction may be established for the beads accelerated by the sonotrodes and that it may moreover be possible to blast rotor disk 26 simultaneously on both sides, surface blasting may result in a good quality even in the case of a thin-walled rotor disk 26.

Figure 3:
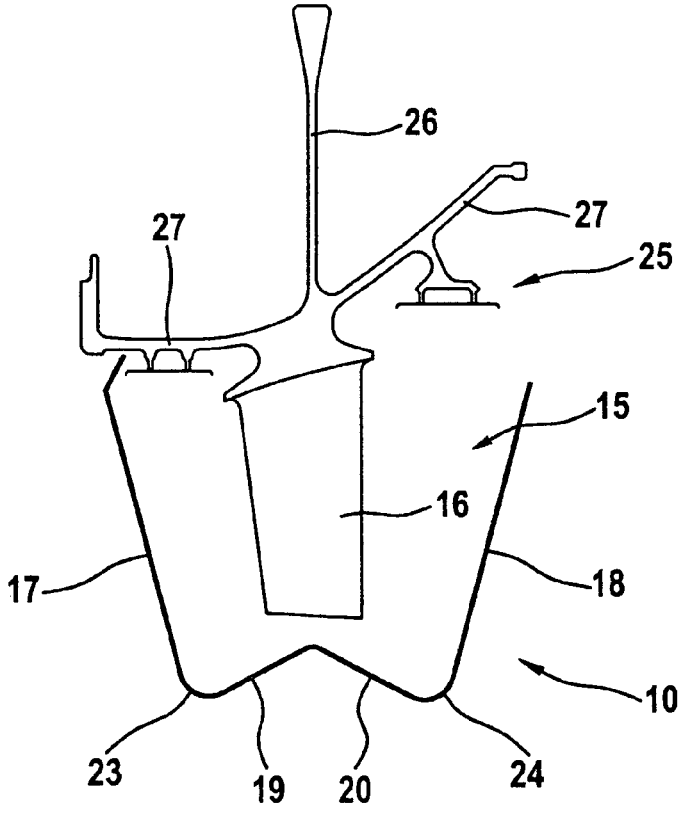
FIG. 3 illustrates a device according to an example embodiment of the present invention for surface blasting, e.g., for ultrasonic shot blasting, in blasting a blade of an integrally bladed gas turbine rotor.

FIG. 3 illustrates device 10 in the blasting of a blade 16 of an integrally bladed gas turbine rotor 25. Blades 16 may therefore also be blasted effectively and at the same time gently using device 10.

Figure 4:
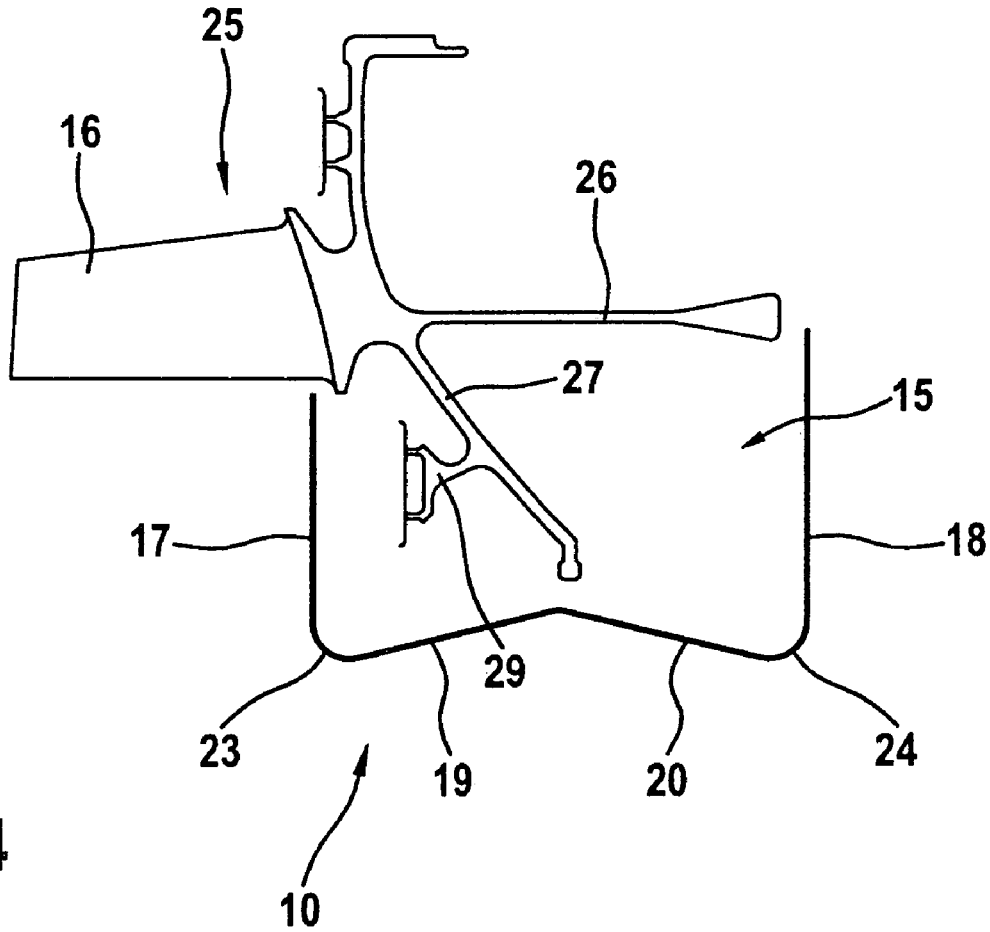
FIG. 4 illustrates a the device according to an example embodiment of the present invention for surface blasting, e.g., for ultrasonic shot blasting, in blasting a thin-walled wing of an integrally bladed gas turbine rotor.

FIG. 4 illustrates device 10 in the blasting of integrally bladed gas turbine rotor 25 in the region of a thin-walled wing 27 and a seal fin support 29. Device 10 illustrated in FIG. 4 differs from devices 10 illustrated in FIGS. 1 to 3 in that, in the exemplary embodiment illustrated in FIG. 4, the two outer long sides 17 and 18 extend substantially parallel to each other. This W-shaped profile may be particularly suitable for blasting thin-walled wings.

Figure 5:
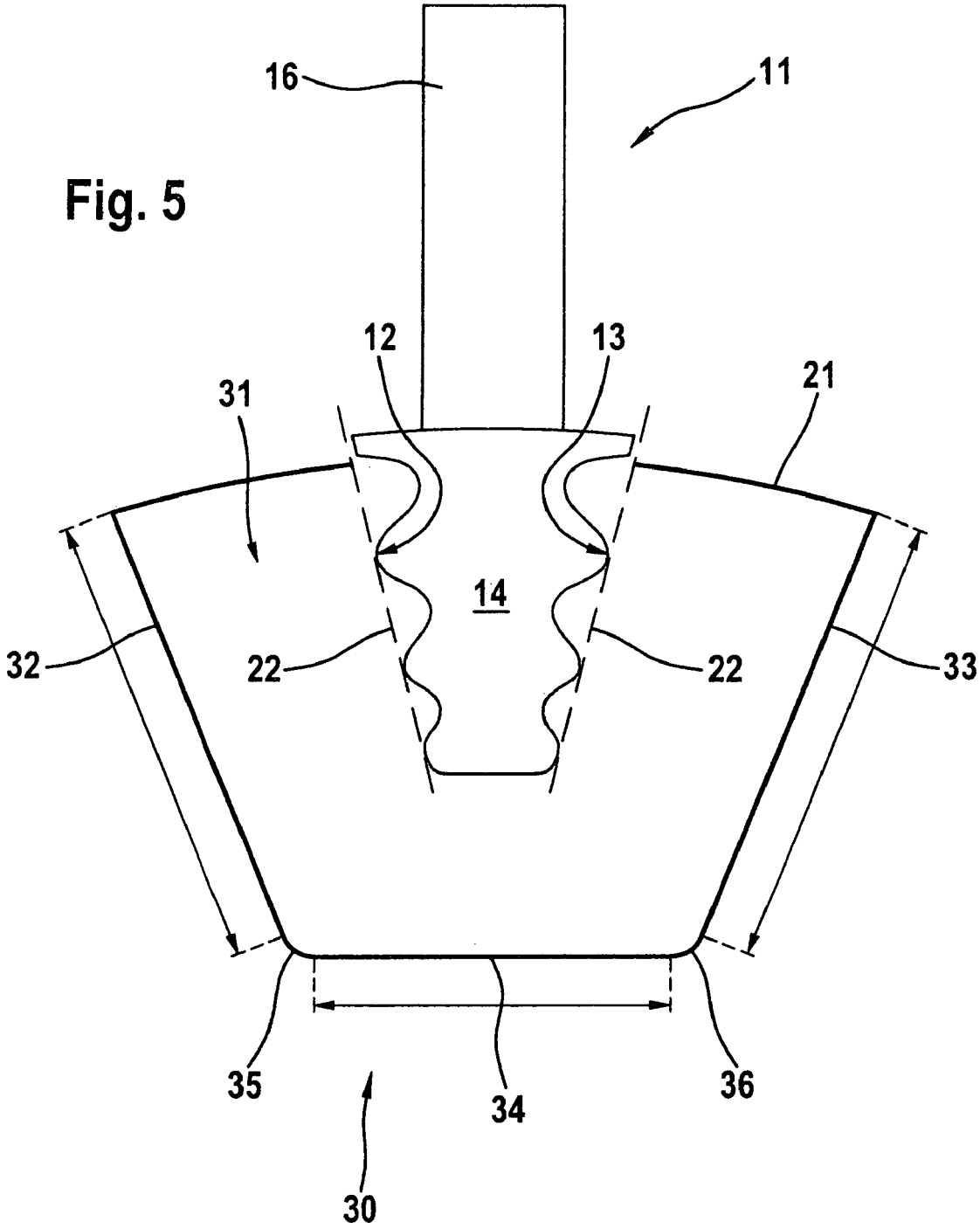
FIG. 5 is a schematic view of a device according to an example embodiment of the present invention for surface blasting, e.g., for ultrasonic shot blasting, in blasting a gas turbine blade in the region of a blade root.

An example embodiment of the present invention is illustrated in FIG. 5. FIG. 5 illustrates schematically a device 30 for ultrasonic shot blasting in connection with a gas turbine blade 11, which in the device 10 is to be blasted at profiled bearing flanks or bearing surfaces 12 and 13 of a blade root 14. As illustrated in FIG. 1, for this purpose, blade root 14 of gas turbine blade 11 extends into a machining chamber 15 provided by the device, a blade 16 of gas turbine blade 11 that is not to be machined in FIG. 1 projecting out of machining chamber 15 of device 10. In the exemplary embodiment illustrated in FIG. 5, machining chamber 31 is V-shaped in its cross-section or characterized by a V-profile. Thus, cross-sectionally V-shaped machining chamber 31 is bounded by two outer, substantially vertical long sides 32 and 33 as well as by one inner, substantially horizontal short side 34. Each of these sides 32, 33 and 34 is formed by a vibrating or oscillating surface of a vibrator, e.g., of an ultrasonic sonotrode. An injector may also be positioned in the region of the substantially horizontal side 34. Oscillating surfaces of ultrasonic sonotrodes are positioned not only in the region of sides 32, 33 and 34 of cross-sectionally V-shaped machining chamber 31, but also in transition regions 35 and 36 between outer long sides 32 and 33 and inner short side 34.

Thus, a device may be provided for surface blasting components, a machining chamber of the device having a W-profile or a V-profile or being W-shaped or V-shaped in its cross-section, and oscillating surfaces of ultrasonic sonotrodes being positioned at least in the region of the substantially vertical sides of the profile. Oscillating surfaces of ultrasonic sonotrodes or even injectors may also be positioned in the transition area between the outer and the inner sides, e.g., at the low mark of the profiles. Such a device may allow for a simultaneous ultrasonic blasting of thin-walled components from both sides in a particularly effective and gentle manner.

The device may be used in blasting thin-walled gas turbine components, e.g., in blasting gas turbine blades in the region of their blade roots or blades as well as in blasting integrally bladed gas turbine rotors in the region of the rotor disks as well as blades of the same.

LIST OF REFERENCE NUMERALS

10 Device
11 Gas turbine blade
12 Bearing surface
13 Bearing surface
14 Blade root
15 Machining chamber
16 Blade
17 Side
18 Side
19 Side
20 Side
21 Cover
22 Envelope
23 Transition region
24 Transition region
25 Gas turbine rotor
26 Rotor disk
27 Projection/Wing
28 Line
29 Seal fin support
30 Device
31 Machining chamber

32 Side
33 Side
34 Side
35 Transition region
36 Transition region

What is claimed is:

1. A device for surface blasting a component, comprising:

at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side and the at least one substantially horizontal side formed by a respective oscillating surface;

wherein the substantially vertical sides are arranged approximately parallel to one of (a) a surface contour and (b) an envelope of the surface contour to be blasted of the section of the component extending into the machining chamber; and wherein each transition region between the substantially vertical sides and the substantially horizontal side one of (a) forms one of the oscillating surfaces and (b) includes an injector.

2. The device according to claim 1, wherein the surface blasting includes ultrasonic shot blasting.

3. The device according to claim 1, wherein the component includes a gas turbine component.

4. The device according to claim 1, wherein the at least one vibrator includes at least one ultrasonic sonotrode.

5. The device according to claim 1, wherein a cross-section of the machining chamber is one of (a) W-shaped and (b) v-shaped.

6. The device according to claim 1, wherein a cross-section of the machining chamber is W-shaped, the at least three sides including two substantially horizontal sides and two substantially vertical sides.

7. The device according to claim 1, wherein a cross-section of the machining chamber is W-shaped and is bounded by two outer, substantially vertical long sides and two inner, substantially horizontal short sides, each of the outer, substantially vertical long sides and the inner, substantially horizontal short sides formed by one of the oscillating surfaces.

8. The device according to claim 1, wherein a cross-section of the machining chamber is V-shaped and includes two substantially vertical sides and one substantially horizontal side, at least each of the substantially vertical sides formed by one of the oscillating surfaces.

9. The device according to claim 8, wherein the substantially horizontal side is formed by one of the oscillating surfaces.

10. The device according to claim 8, wherein the substantially horizontal side includes an injector.

11. A device for surface blasting a component, comprising:

at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by a respective oscillating surface;

wherein a cross-section of the machining chamber is W-shaped and is bounded by two outer, substantially vertical long sides and two inner, substantially horizontal short sides, each of the outer, substantially vertical long sides and the inner, substantially horizontal short sides formed by a respective oscillating surface; and wherein each transition region between the outer, substantially vertical long sides and the inner, substantially horizontal short sides one of (a) forms one of the oscillating surfaces and (b) includes an injector.

12. The device according to claim 11, wherein one of (a) the oscillating surfaces at the transition regions and (b) the injectors are arranged at low points of the W-shaped cross-section of the machining chamber.

13. The device according to claim 11, wherein the machining chamber is bounded by one of (a) six oscillating surfaces and (b) four oscillating surfaces and two injectors.

14. A device for surface blasting a component, comprising:

at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by a respective oscillating surface;

wherein a cross-section of the machining chamber is V-shaped and includes two substantially vertical sides and one substantially horizontal side, at least each of the substantially vertical sides formed by one of the oscillating surfaces; and wherein each transition region between the substantially vertical sides and the substantially horizontal side one of (a) forms one of the oscillating surfaces and (b) includes an injector.

15. A method, comprising:

blasting a component in a device for surface blasting the component, the device including at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side and the at least one substantially horizontal side formed by a respective oscillating surface;

wherein the substantially vertical sides are arranged approximately parallel to one of (a) a surface contour and (b) an envelope of the surface contour to be blasted of the section of the component extending into the machining chamber; and wherein each transition region between the substantially vertical sides and the substantially horizontal side one of (a) forms one of the oscillating surfaces and (b) includes an injector.

16. The method according to claim 15, wherein the blasting includes ultrasonic shot blasting the component in the device.

17. The method according to claim 15, wherein the component includes a gas turbine component.

18. The method according to claim 15, wherein the blasting includes blasting the component in the device simultaneously from both sides.

19. A method, comprising:

simultaneously, bilaterally, ultrasonically shot blasting a component in a device for surface blasting the component, the component including one of (a) a gas turbine blade and (b) an integrally bladed gas turbine rotor, the device including at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side and the at least one substantially horizontal side formed by a respective oscillating surface;

wherein the substantially vertical sides are arranged approximately parallel to one of (a) a surface contour and (b) an envelope of the surface contour to be blasted of the section of the component extending into the machining chamber; and wherein each transition region between the substantially vertical sides and the substantially horizontal side one of (a) forms one of the oscillating surfaces and (b) includes an injector.

20. The method according to claim 19, wherein the component is shot blasted in the shot blasting step in a region of a thin-walled section.

21. A device for surface blasting a component, comprising:

at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by a respective oscillating surface;

wherein the substantially vertical sides are arranged approximately parallel to one of (a) a surface contour and (b) an envelope of the surface contour to be blasted of the section of the component extending into the machining chamber;

wherein a cross-section of the machining chamber is W-shaped and is bounded by two outer, substantially vertical long sides and two inner, substantially horizontal short sides, each of the outer, substantially vertical long sides and the inner, substantially horizontal short sides formed by one of the oscillating surfaces;

wherein each transition region between the outer, substantially vertical long sides and the inner, substantially horizontal short sides one of (a) forms one of the oscillating surfaces and (b) includes an injector.

22. The device according to claim 21, wherein one of (a) the oscillating surfaces at the transition regions and (b) the injectors are arranged at low points of the W-shaped cross-section of the machining chamber.

23. The device according to claim 21, wherein the machining chamber is bounded by one of (a) six oscillating surfaces and (b) four oscillating surfaces and two injectors.

24. A device for surface blasting a component, comprising:

at least one vibrator having at least one oscillating surface arranged to define a machining chamber adapted to receive a section to be blasted of the component, the machining chamber bounded cross-sectionally by at least three sides, including at least two substantially vertical sides and at least one substantially horizontal side, each substantially vertical side formed by a respective oscillating surface;

wherein the substantially vertical sides are arranged approximately parallel to one of (a) a surface contour and (b) an envelope of the surface contour to be blasted of the section of the component extending into the machining chamber;

wherein a cross-section of the machining chamber is V-shaped and includes two substantially vertical sides and one substantially horizontal side, at least each of the substantially vertical sides formed by one of the oscillating surfaces;

wherein each transition region between the substantially vertical sides and the substantially horizontal side one of (a) forms one of the oscillating surfaces and (b) includes an injector.

* * * * *